US009359733B2

(12) United States Patent
Gehman et al.

(10) Patent No.: US 9,359,733 B2
(45) **Date of Patent: *Jun. 7, 2016**

(54) FOLDING SNOW SHOVEL

(75) Inventors: Michael Christopher Gehman, York, PA (US); Joshua O. Mullen, Duncannon, PA (US); Eric Daniel Hyp, Harrisburg, PA (US)

(73) Assignee: THE AMES COMPANIES, INC., Camp Hill, PA (US)

( * ) Notice: Subject to any disclaimer, the term of this patent is extended or adjusted under 35 U.S.C. 154(b) by 974 days.

This patent is subject to a terminal disclaimer.

(21) Appl. No.: 13/113,341

(22) Filed: May 23, 2011

(65) Prior Publication Data

US 2012/0049550 A1 Mar. 1, 2012

Related U.S. Application Data

(63) Continuation of application No. 12/862,846, filed on Aug. 25, 2010, now Pat. No. 7,946,637.

(51) Int. Cl.
*E01H 5/02* (2006.01)
*A01B 1/22* (2006.01)

(52) U.S. Cl.
CPC ..... *E01H 5/02* (2013.01)

(58) Field of Classification Search
USPC ..... 294/54.5, 51, 53.5, 176, 55.5, 58, 59, 294/60; D8/10; 37/285
See application file for complete search history.

(56) References Cited

U.S. PATENT DOCUMENTS

| | | | | |
|---|---|---|---|---|
| 2,629,624 | A | 2/1953 | Nelles | |
| 3,975,043 | A * | 8/1976 | Miles | 294/25 |
| 4,188,055 | A | 2/1980 | Green | |
| 4,424,997 | A | 1/1984 | Jackson | |
| 4,523,781 | A * | 6/1985 | Brody | 294/25 |
| 4,802,785 | A * | 2/1989 | Richards | 403/27 |
| 5,359,840 | A * | 11/1994 | Costar | 294/50.8 |
| D376,965 | S | 12/1996 | Spear et al. | |
| 5,676,412 | A | 10/1997 | Kahley | |
| 5,983,504 | A * | 11/1999 | Tisbo et al. | 294/54.5 |
| D426,436 | S | 6/2000 | Ng | |
| 6,412,843 | B1 | 7/2002 | Burbrink et al. | |
| 6,805,513 | B2 * | 10/2004 | Marquina | 403/107 |
| D543,426 | S | 5/2007 | Donaldson | |
| D551,524 | S | 9/2007 | Norton et al. | |
| D563,182 | S | 3/2008 | Kopp | |
| 7,384,084 | B2 * | 6/2008 | McIlrath | 294/50.8 |
| 7,571,945 | B2 | 8/2009 | Walker et al. | |
| D613,006 | S * | 3/2010 | Anderson | D30/162 |
| D613,136 | S | 4/2010 | Begin et al. | |
| 7,850,216 | B2 * | 12/2010 | Randolph et al. | 294/49 |
| 7,946,637 | B1 * | 5/2011 | Gehman et al. | 294/54.5 |
| 8,061,749 | B2 * | 11/2011 | Risch et al. | 294/99.2 |

FOREIGN PATENT DOCUMENTS

| | | |
|---|---|---|
| FR | 2728917 | * 12/1995 |
| FR | 2728917 | 5/1996 |

* cited by examiner

*Primary Examiner* — Paul T Chin

(74) *Attorney, Agent, or Firm* — Brooks Kushman P.C.

(57) ABSTRACT

A foldable shovel structured for scooping/pushing is provided. The disclosed foldable shovel includes two arcuate members that are hinged together at one end. In the folded configuration the two arcuate members are nested. Further, the coupling device includes a locking disk assembly structured to allow the arcuate members to be configured in different positions relative to each other. Thus, the foldable shovel may be optimally configured as either a scooping device or a pushing device.

19 Claims, 7 Drawing Sheets

FOLDING SNOW SHOVEL

CROSS REFERENCE TO RELATED APPLICATION

This application is a continuation-in-part of U.S. patent application Ser. No. 12/862,846, filed Aug. 25, 2010, entitled FOLDING SNOW SHOVEL.

FIELD OF THE INVENTION

The present invention relates to shovels and, more specifically to a folding shovel.

BACKGROUND OF THE INVENTION

Shovels typically serve one of two purposes, digging or scooping/pushing. A traditional garden shovel, i.e. a digging shovel, has a narrow pointed blade whereas a traditional snow shovel, i.e. a scooping/pushing shovel, has a wide, arcuate blade with a flat leading edge. Generally, folding shovels have been constructed as digging shovels having a narrow pointed blade. These devices typically include a pole-like handle constructed of a plurality of collapsible links and/or of a plurality of telescoping members. It is noted that shovels having only a telescoping handle are typically describes as "collapsible" rather than "folding." Foldable, or collapsible, scooping/pushing shovels exist as well and typically include a telescoping handle.

Folding/collapsing shovels are structured to occupy a limited space in their unexpanded configuration. Foldable digging shovels are typically used by soldiers and campers. Folding/collapsing scooping/pushing shovels are typically stored in vehicles for emergency use. Because of the purpose/intended use of such shovels, the ability to be reduced to as small as possible is an important feature of folding shovels. Collapsing scooping/pushing shovels, such as those disclosed in U.S. Pat. Nos. D543,426 and 7,571,945 suffer from the disadvantage of having the handle member extend well beyond the perimeter of the blade. This disadvantage is not seen, or is not as pronounced, in folding digging shovels, see e.g. U.S. Pat. No. D551,524. Preferably, a scooping/pushing shovel includes an arcuate blade as this shape is better adapted for moving snow. An arcuate blade, however, increases the space required for storage of the shovel in the unexpanded configuration. U.S. Pat. No. 7,571,945 addresses this issue by providing an arcuate handle/shaft that is stored over the arcuate blade. In the expanded configuration, the entire shovel, i.e. the blade and handle, have an arcuate shape that is not conducive to pushing snow.

A further disadvantage of telescoping handles is that the handle is in a fixed relationship (angle) to the blade. As such, the shovel is not optimized for either pushing or scooping. Further, telescoping handles typically include an expensive/complicated locking mechanism that is subject to degradation from debris becoming lodged therein. This is less of a problem with simple hinged folding shovels.

SUMMARY OF THE INVENTION

The purpose of the present disclosure is to provide a foldable shovel that is structured for scooping/pushing. Such a shovel combines the advantages of a folding shovel with the capabilities of a scooping/pushing shovel. The disclosed foldable shovel includes two arcuate members, or an arcuate member and a generally flat member, that are hinged together at one end. In the folded configuration the two arcuate members are nested and, because the coupling device is disposed at the ends of the members, the member that acts as a handle does not extend significantly beyond the member that acts as a blade. Further, the coupling device includes a locking disk assembly structured to allow the arcuate members to be configured in different positions relative to each other. Thus, the foldable shovel may be optimally configured as either a scooping device or a pushing device. Further, the arcuate members may be made from a highly visible color and configured at an acute angle. In this configuration, the shovel may also be used as an indicator for a hazard.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, "handle" and "grip" are defined as follows. A "handle" is any member, or a portion of a member, that may be grasped comfortably. A "grip" is any member, or a portion of a member, that is structured to be grasped. For example, the shaft of a typical long handle shovel may be grasped virtually anywhere over its length; thus the entire shaft is a "handle." Some long handle shovel may include a padded portion at the distal tip of the shaft, the distal tip may be slightly enlarged, and/or the distal tip may have a textured surface. Structures such as these are "grips." Further, any member structured to be gripped which extends generally perpendicular to a shaft, e.g. a T-grip or a D-grip, is a "grip" as used herein. As used herein, "telescoping" means any configuration with an elongated member moving axially within another hollow member.

As used herein a "highly visible color" means any bright, reflective, or fluorescent color as well as any high contrast color combinations, such as, but not limited to, yellow and black (as on a yield sign), red and white (as on a stop sign), and green and white (as on a highway road sign).

As used herein, a "vertex" is an area where two generally straight members meet.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body.

As used herein, an "edge" means a portion of the perimeter of a member. An "edge" is not limited to a corner or another sharp rim like structure. Further, the presence of an opening at an edge does not reduce the limit of the edge. For example, if a body has a U-shape, the upper edge extends between the tips of the "U" despite the presence of a gap/opening.

As used herein, "correspond" indicates that two structural components are structured to fit together. For example, two identical spoons "correspond" to each other and may be placed in a nested configuration. One component, however, may have a slightly different size than the other. For example, a protective case for a cellular telephone "corresponds" to the shape of the telephone but is slightly larger than the telephone.

Figure 1:
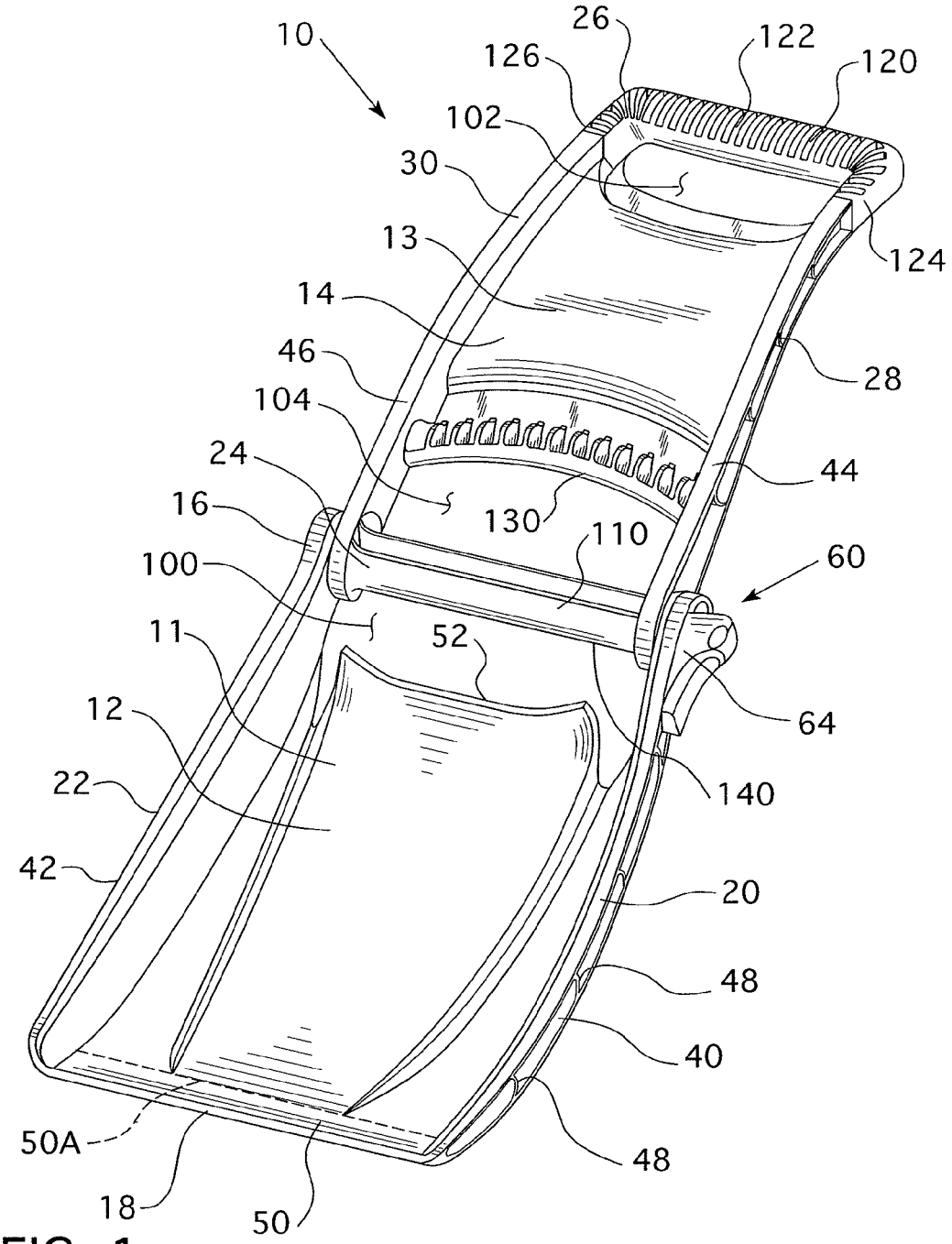
FIG. 1 is an isometric view of the snow shovel in a fully extended configuration.
Figure 2:
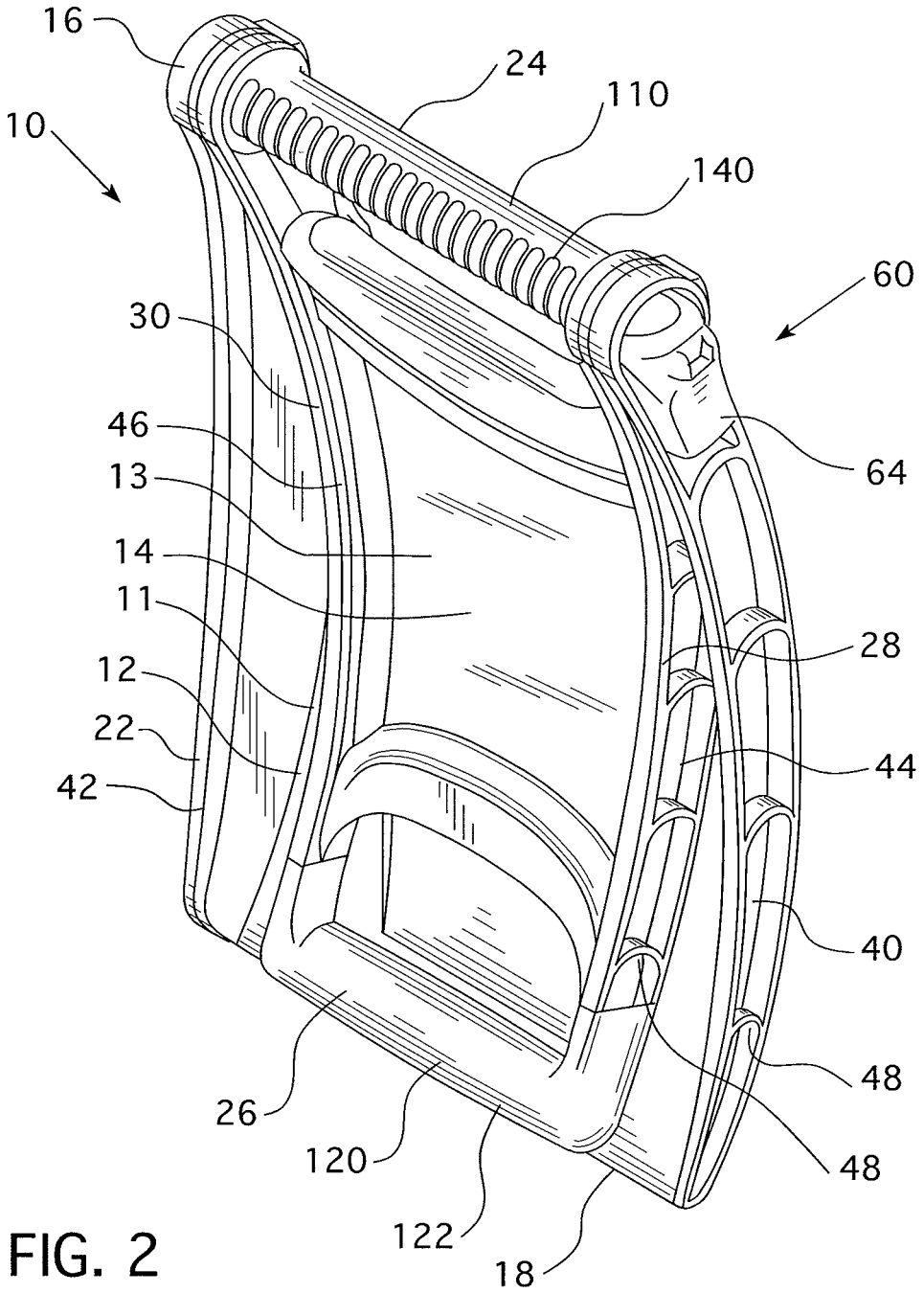
FIG. 2 is an isometric view of the snow shovel in a folded configuration.
Figure 3:
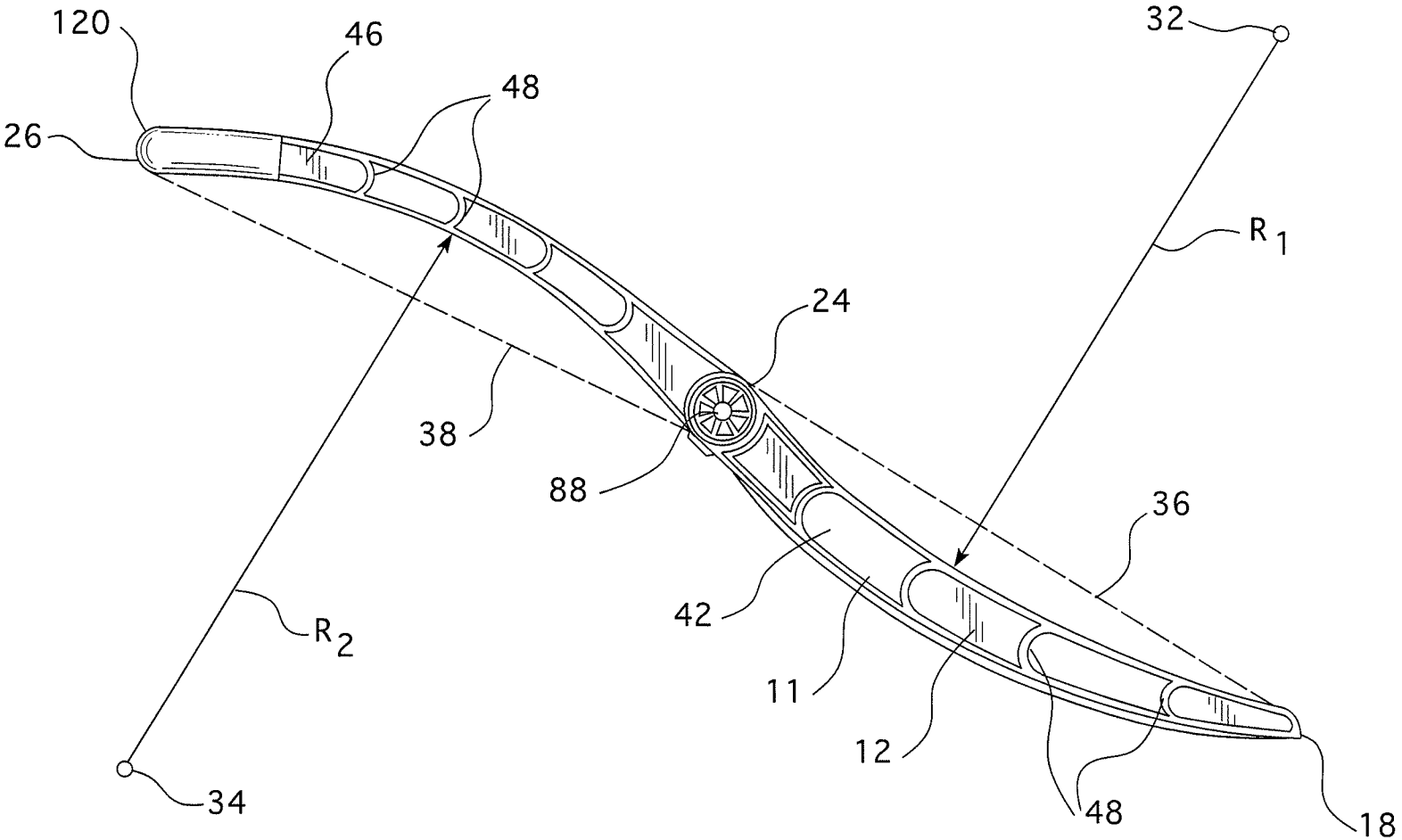
FIG. 3 is a side view of the snow shovel in an extended configuration.
Figure 7:
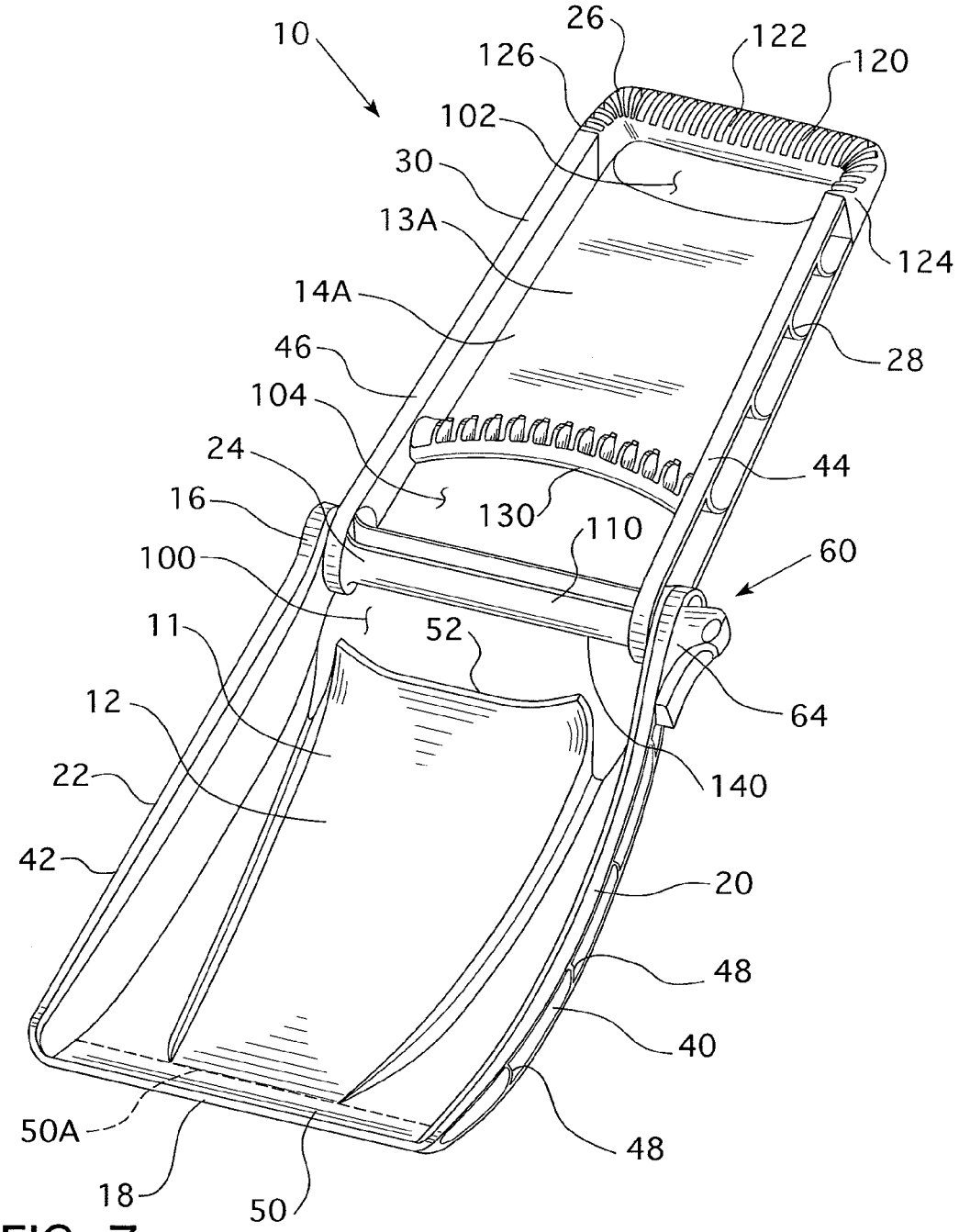
FIG. 7 is an isometric view of an alternate embodiment of the snow shovel in a fully extended configuration.

As shown in FIGS. 1-2, a folding snow shovel 10 includes a first curved surface member 11 having a body 12 and a second curved surface member 13 having a body 14, or, in a second embodiment as shown in FIG. 7, the second member 13A may be a planar member having a generally planar body 14A. It is noted that the remaining features of the alternate embodiment (FIG. 7) are substantially similar to the embodiment shown in FIG. 1. As such, common names and reference numbers will be used to indicate the same features when applicable. The first curved surface member body 12 is thin (compared to the length and width), generally arcuate and elongated having a first proximal edge 16, a second distal edge 18, a width and two, i.e. first and second, lateral sides 20, 22. The first curved surface member body lateral sides 20, 22 are, preferably, generally parallel. The second member body 14 is also thin (compared to the length and width), generally arcuate, or in the alternate embodiment (FIG. 7), a generally planar body 14A, and elongated with a first proximal edge 24, a second distal edge 26, a width and two, i.e. first and second, lateral sides 28, 30. The second member body lateral sides 28, 30 may be generally parallel or tapered toward the second member second distal edge 26. In the first embodiment, the second curved surface member body 14 has a curvature corresponding to the curvature of the first curved surface member body 12. As shown in FIG. 3, each curved surface member body 12, 14 member is shaped generally as an arc having a center 32, 34 (first and second curved surface member, respectively) and defining a chord 36, 38 (first and second curved surface member, respectively) extending from the proximal edge 16, 24 to the distal edge 18, 26. It is noted that in the alternate embodiment, shown in FIG. 7, the planar member 14A does not define a chord. A longitudinal line 38A, however, serves the purpose of enabling this description to identify selected angles. Accordingly, it is understood that the "chord" of the alternate embodiment, i.e. planar member 14A, is a longitudinal line, or alternately, an infinite chord. As shown in FIGS. 1 and 7, the first and second member bodies 12, 14 or 14A preferably each include first and second stiffening members 40, 42 and 44, 46 (first and second member, respectively). The first and second stiffening members 40, 42 and 44, 46 are disposed at the lateral sides 20, 22 and 28, 30 of the first and second member bodies 12,14 or 14A, respectively. Each include first and second stiffening members 40, 42 and 44, 46 and preferably have a U-shaped cross-section with the "tines" of the U-shape extending outwardly and generally parallel to the arc defined by the associated member body 12, 14 or 14A. Each first and second stiffening members 40, 42 and 44, 46 may include support ribs 48 extending between the "tines" of the U-shaped cross-sectional stiffening members 40, 42, 44, 46.

The first curved surface member body second distal edge 18 defines a blade 50. The blade 50 may be a thin and/or tapered portion of the first curved surface member body 12. Alternatively, the first and second member bodies 12, 14, 14A may be made from a non-metallic material and the blade 50 may be a metal blade 50A that is coupled to the first curved surface member body second distal edge 18 defines a blade 50. Further, the first curved surface member body 12 includes a radial extension 52. The radial extension 52 extends generally toward the center of the arc defined by said first curved surface member body 12. This extension 52 is structured to resist the movement of snow, or any material being moved, over the first curved surface member body proximal edge 16.

The first and second member bodies 12, 14 or 14A are rotatably coupled together adjacent, or at, each member's first proximal edge 16, 24. The axis of rotation extends substantially perpendicular to each of the first and second members' 12, 14 or 14A longitudinal axis. The first and second members 12, 14 or 14A are preferably coupled by a device that may be maintained in a selected configuration, e.g. a hinge assembly having a ratchet and pawl (not shown). In one embodiment, the coupling device is a locking disk assembly 60.

Figure 4:
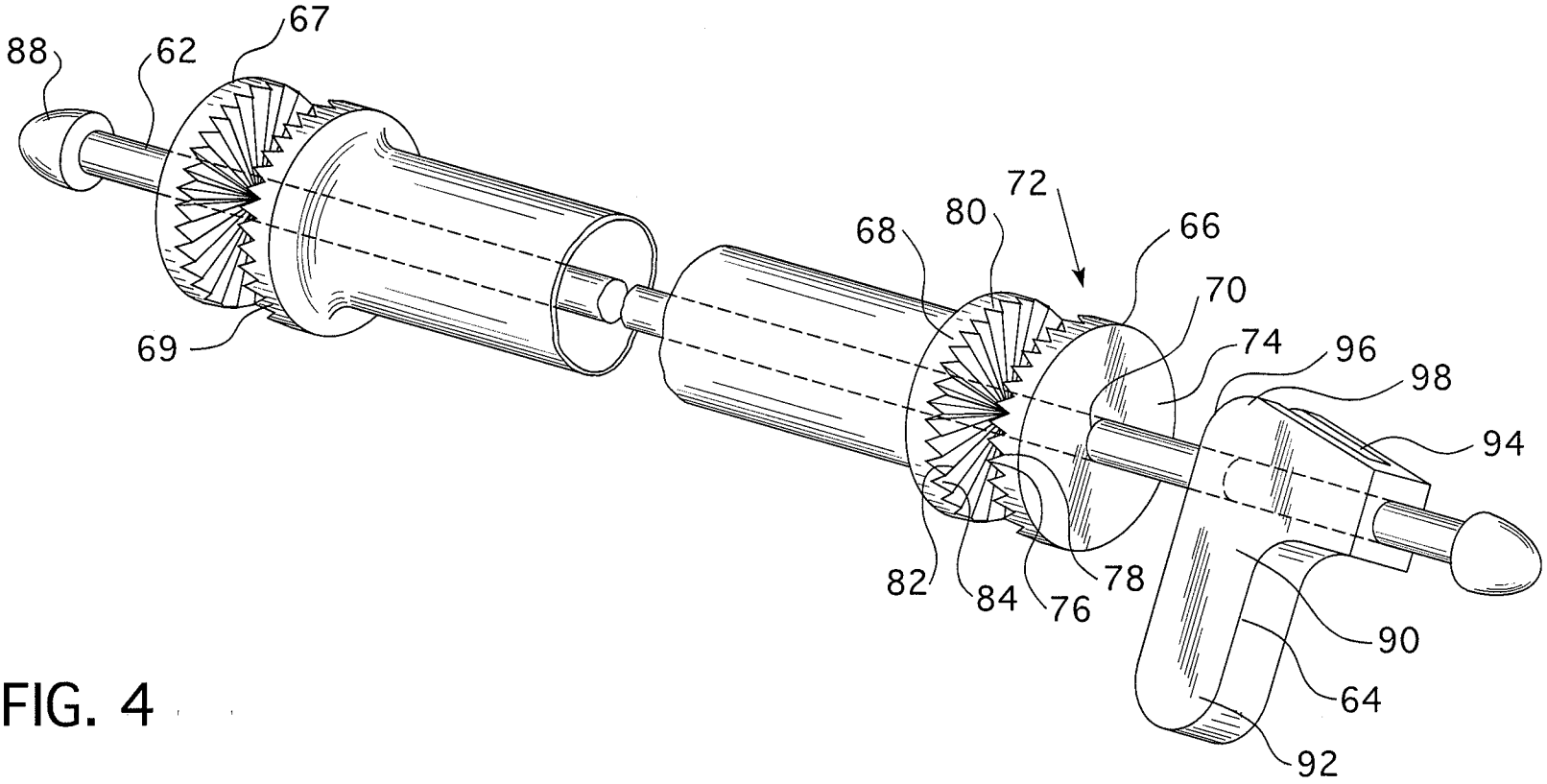
FIG. 4 is an exploded view of the locking disk assembly.

As shown in FIG. 4, the locking disk assembly 60 includes an axle 62, a cam member 64, at least two disks 66, 68. The at least two disks 66, 68 includes a first disk 66 and a second disk 68, each disk having a center opening 70. The first disk 66 has an interface side 72 and an outer side 74. The first disk interface side 72 has a plurality of radial ridges 76 and grooves 78. Similarly, the second disk 68 has an interface side 80 with a plurality of radial ridges 82 and grooves 84. The second disk interface side radial ridges and grooves 82, 84 correspond to the first disk interface side radial ridges and grooves 76, 78. The first and second disks 66, 68 are disposed with their interface sides 72, 80 engaging each other. The axle 62 extends through the center opening 70 of each of the first and second disks 66, 68. The axle 62 has a cap 88 on each end structured to prevent the axle 62 sliding through the center openings 70.

The cam member 64 has an L-shaped body 90 with a lever arm 92, an extension 94, and a cam surface 96. The lever arm 92 is, preferably, longer than the extension 94. The lever aim 92 and the extension 94 are coupled at a vertex 98. The cam surface 96 extends over the outer surface of the vertex 98.

When the locking disk assembly 60 is assembled, the cam member 64 is pivotally coupled to the axle 62 with the extension 94 engaging an axle cap 88. The cam surface 96 engages the first disk outer side 74. The axle 62 is sized to prevent the first and second disks 66, 68 from substantially separating. That is, the axle 62 has a sufficient length to allow the first and second disks 66, 68 to separate a distance slightly more than the height, or depth, of the ridges 76, 82 or grooves 78, 84. In this configuration, the cam member 64 is structured to move between a first, locked position, wherein the lever arm 92 extends generally parallel to the first disk outer side 74 and wherein the first and second disks 66, 68 are biased together with the ridges 76, 82 and grooves 78, 84 interlocking, and a second, open position, wherein the lever arm 92 extends at an angle to the first disk outer side 74 and wherein the first and second disks 66, 68 are not biased together thereby allowing the first and second disk interface sides 72, 80 to rotate relative to each other. In this configuration, the disks 66, 68 may be positioned and locked in a selected orientation relative to each other. The first disk 66 is fixed to the first curved surface member body 12 and the second disk 68 is fixed to the second member body 14 or 14A. Thus, as discussed below, the first and second member bodies 12, 14 or 14A may be moved into a selected orientation relative to each other and locked in that configuration.

As shown in FIG. 1, in the preferred embodiment, both the first and second member bodies 12, 14 or 14A have openings 100, 102, 104 at, or adjacent to, the associated proximal end 16, 24. That is, the first curved surface member body 12 includes an opening 100 at the first curved surface member body proximal edge 16. The first curved surface member body proximal edge opening 100 is laterally elongated and extends substantially across the lateral width of the first curved surface member body 12. Thus, the two first curved surface member body first and second stiffening members 40, 42 extend generally parallel to the longitudinal axis of the first curved surface member body 12.

The second member body 14 or 14A includes a first and second opening 102, 104, with one opening adjacent to each of the second member body proximal and distal edges 24, 26. An opening that is adjacent to an edge, as opposed to an opening that is at an edge, does not extend to the edge. That is, the second member body first opening 102 is an elongated lateral opening extending substantially parallel and adjacent to the second member body second distal edge 24. The second member body first opening 104 extends substantially across the lateral width of said second member body 14 or 14A. As with the first curved surface member body proximal edge opening 100, this configuration leaves the two stiffening members 44, 46 on either side of the second member body first opening 102. Further, because the second member body first opening 102 is adjacent, rather than at, the second member body second distal edge 26, there is also a lateral member extending across the second member body second distal edge 26. This lateral member is the first grip 120 discussed below.

The second member body second opening 104 is an elongated lateral opening extending substantially parallel and adjacent to the second member body first proximal edge 24. As before, the second member body second opening 104 results in the two stiffening members 44, 46 extending on either side of the second member body second opening 104. Further, because the second member body second opening 104 is adjacent, rather than at, the second member body first proximal edge 24, there is also a lateral member extending across the second member body first proximal edge 24. This lateral member is a tubular portion 110.

The tubular portion 110 operates cooperatively with an embodiment of the locking disk assembly 60 having four disks, i.e. a first disk 66 and a second disk 68, and, a third disk 67 and a fourth disk 69. The third and fourth disks 67, 69 are substantially similar to the first and second disks 66, 68, and identical reference numbers shall be used to identify the ridges, grooves and openings on the third and fourth disks 67, 69, respectively. The first disk 66 is located at the first curved surface member body proximal edge 16, and more specifically at the tip of the extending stiffening member 40 located on the first curved surface member body first lateral side 20. The third disk 67 is located at the first curved surface member body proximal edge 16, and more specifically at the tip of the extending stiffening member 42 located on the first curved surface member body second lateral side 22. The second disk 68 is disposed at the second member body proximal edge, and more specifically, on an axial face of the tubular portion 110 on the second member body first lateral side 28. The fourth disk 69 is disposed at the second member body proximal edge 22, and more specifically, on an axial face of the tubular portion 110 on the second member body second lateral side 30. Further, the tubular portion 110 includes a center opening 112. In this configuration, the axle 62 extends through, in order, the cam member 64, the first and second disks 66, 68, the tubular portion 110, and the fourth and third disks 69, 67. An axle cap 88 is disposed on the outer side of the third disk 67. As before, the cam member 64 is structured to move between a first, locked position, wherein the lever 92 extends generally parallel to the first disk outer side 74 and wherein the first and second disks 66, 68 and the third and fourth disks 67, 69 are biased together with the ridges 76, 82 and grooves 78, 84 interlocking, and a second, open position, wherein the lever arm 92 extends at an angle to the first disk outer side 74 and wherein the first and second disks 66, 68 and the third and fourth disks 67, 69 are not biased together thereby allowing the first and second disk interface sides 72, 80 to rotate relative to each other.

The folding snow shovel 10 preferably includes a plurality of grips. A first grip 120 is defined by the lateral member disposed at the member body second distal edge as discussed above. The first grip 120 is shaped/contoured to be comfortable when grasped by a user. The first grip 120 may also include padding or texturing (not shown). The first grip 120 may also extend over the two stiffening members 44, 46 on either side of the second member body first opening 102. That is, in this configuration, the second member first grip 120 is U-shaped having a first portion 122, a second portion 124, and a third portion 126. The second member first grip first portion 122 extends across the second member second distal edge 26 and is, essentially, the embodiment of the grip described above. The grip second and third portions 124, 126 extend generally perpendicular to the grip first portion 122 and along the outer edges, which are preferably the two stiffening members 44, 46, of the second member body 14 or 14A immediately adjacent the grip first portion 122.

A second grip 130 is spaced from said first proximal edge 24 on the second member body 14 or 14A. That is, the inner edge of the second member body second opening 104 may act as a grip 130. Thus, the inner edge of the second member body second opening 104 may be shaped/contoured to be comfortable when grasped by a user. The second grip 130 may also include padding or texturing (not shown).

The first and second grips 120, 130 are disposed on the second member body 14 or 14A and are primarily used when operating the folding snow shovel 10. A third grip 140 may be used as a carrying grip. That is, the tubular portion 110 described above may be shaped/contoured to be comfortable when grasped by a user. The third grip 140 may also include padding or texturing (not shown). When the first and second member bodies 12, 14 or 14A are in the folded configuration, described below, the third grip 140 provides a convenient location to hold on to the folding snow shovel 10.

Figure 5:
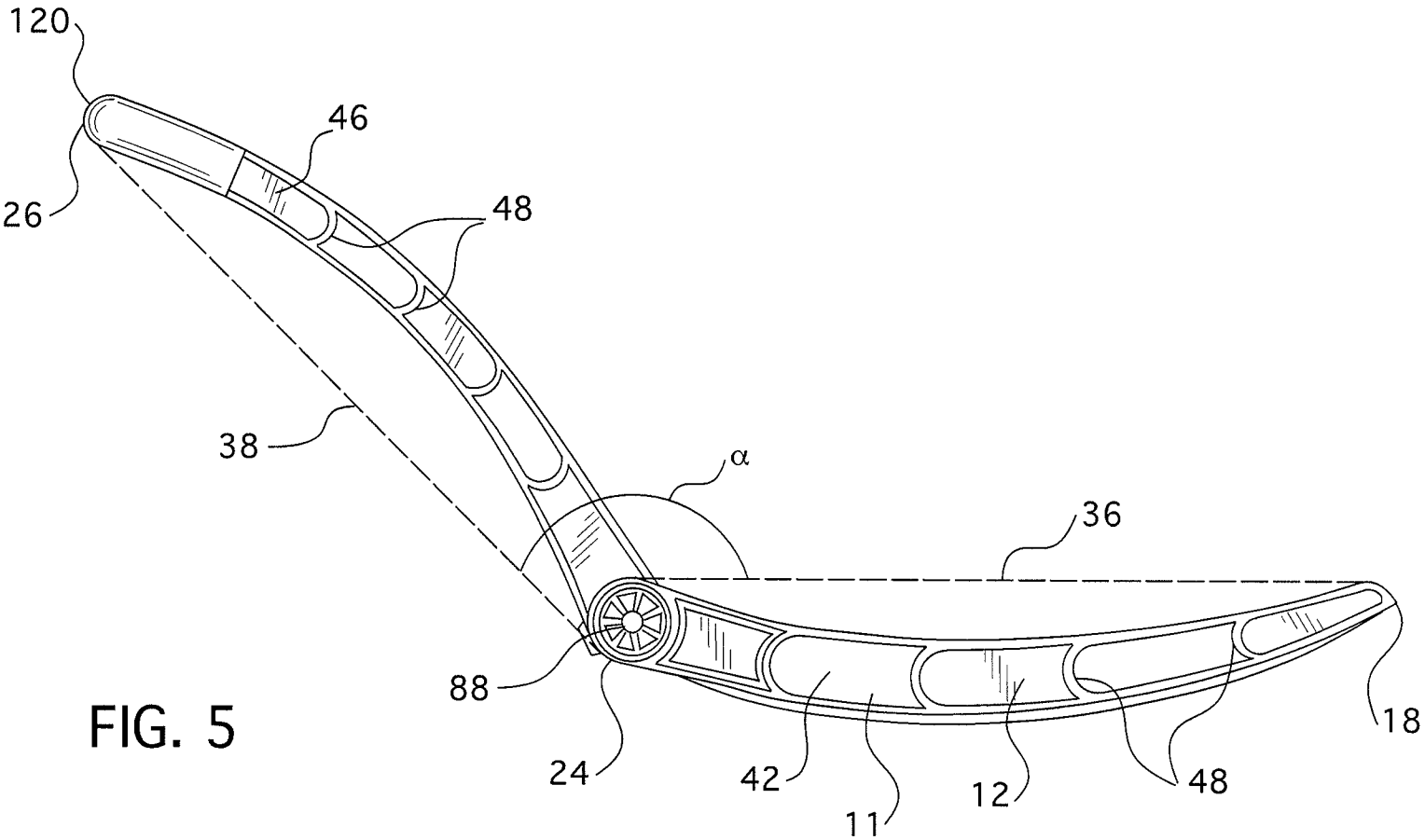
FIG. 5 is a side view of the snow shovel in a extended configuration.

When the first and second member bodies 12, 14 or 14A are rotatably coupled by the locking disk assembly 60 as described above, the first and second members 11, 13 are structured to move between a first, folded configuration, and a second, extended configuration, wherein the chords 36, 38 defined by said first and second member bodies 12, 14 or 14A are at an obtuse angle $\alpha$, as shown in FIG. 5. In this configuration, the folding snow shovel 10 may be used as a scoop. The first and second member bodies 12, 14 or 14A may be moved to a third, fully extended configuration, wherein the chords 36, 38 defined by the first and second member bodies 12, 14 or 14A are at an angle greater than about 130 degrees. In the third, fully extended configuration the folding snow shovel 10 may be used as a snow pusher. It is noted that when the bodies are first and second curved surface member bodies 12, 14 the first and second curved surface members 11, 13 are nested together in the first configuration.

Figure 6:
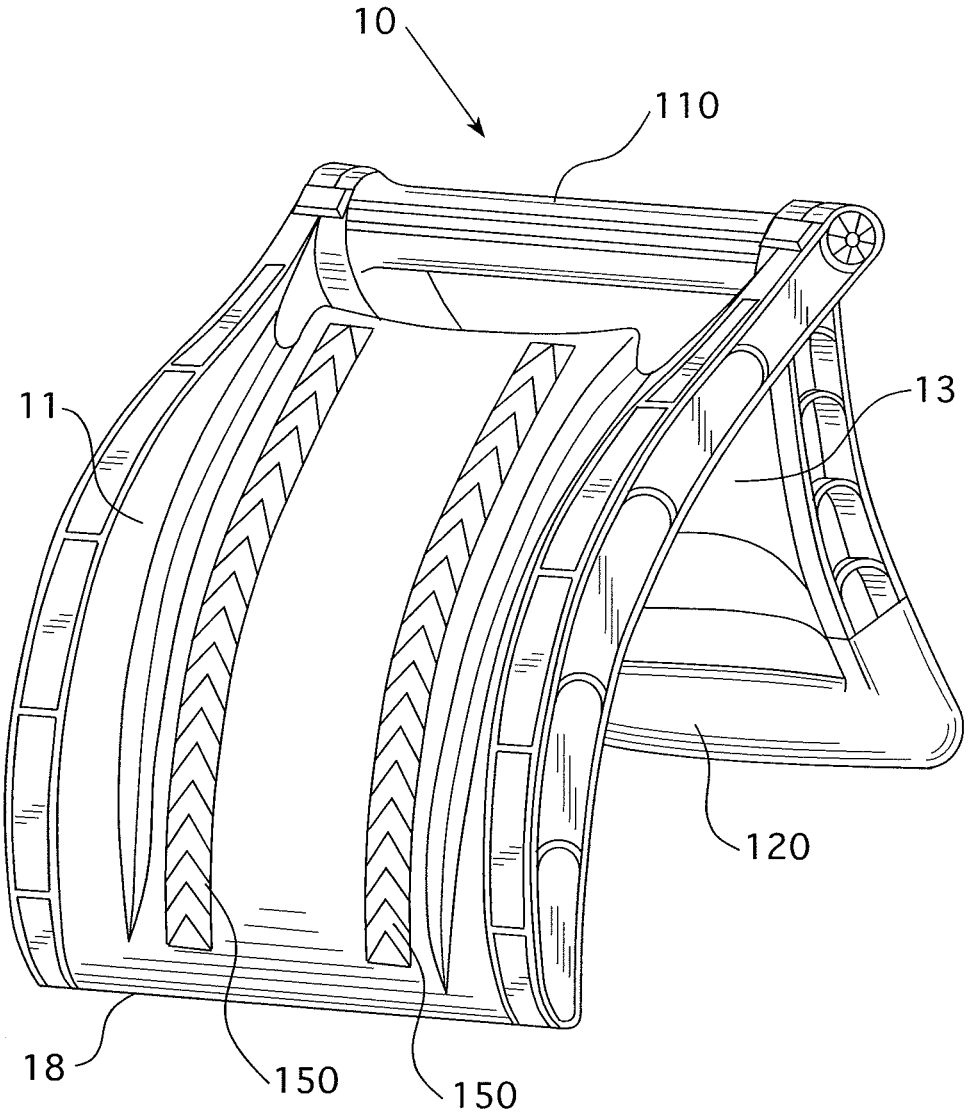
FIG. 6 is an isometric view of the snow shovel in a fourth configuration.

While not a primary use of the folding snow shovel 10, the disclosed configuration further allows the folding snow shovel 10 to be used as an indicator for a hazard. That is, the folding snow shovel 10 may be placed in a fourth configuration, as shown in FIG. 6. In this configuration, the chords 36, 38 defined by said first and second member bodies 12, 14 or 14A are at an acute angle thereby allowing the folding snow shovel 10 to be set upon the first and second member bodies second distal edges 18, 26. To enhance the effect as an indicator for a hazard, the first and second member bodies 12, 14 or 14A may be made from a material having a highly visible color. Alternatively, at least one of the first and second members 11, 13 or 13A may have a material of a highly visible color, such as, but not limited to a strip of reflective tape, coupled thereto.

As a folding snow shovel 10 is structured for portability and storage in a small space, the size of the snow shovel 10 is important. Preferably, the first curved surface member body 12 has a length of between about 13 inches and 17 inches, and more preferably about 16 inches. The first curved surface member body 12 has a width of between about 8⅝ inches and 10½ inches, and more preferably about 9½ inches. The first curved surface member body 12 has radius of curvature of between about 19 inches and 22 inches, and more preferably about 20% inches. The second member body 14 has a length of between about 12 inches and 16 inches, and more preferably about 15¾ inches. The second member body 14, 14A has a width of between about 5 inches and 8 inches, and more preferably about 7⅝ inches. If the second member body 14 is arcuate, the second curved surface member body 14 has radius of curvature of between about 14 inches and 16 inches and more preferably about 15¼ inches.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A folding snow shovel comprising:

a first curved surface member having a generally arcuate, elongated body with a first proximal edge, a second distal edge, two lateral sides and a width;

a second member having a generally elongated body with a first proximal edge, a second distal edge, two lateral sides and a width;

said first and second members rotatably coupled together adjacent each said member's first proximal edge, the axis of rotation extending substantially perpendicular to each of said first and second members' longitudinal axis;

said second member body is generally planar;

said first member defining a chord extending between said first member first proximal edge and said first member second distal edge, said first member chord extending generally perpendicular to said axis of rotation;

said second member defining a chord extending between said second member first proximal edge and said second member second distal edge, said second member chord extending generally perpendicular to said axis of rotation; and said first and second members are structured to move between a first, folded configuration and a second, extended configuration, wherein the chords defined by said first and second member bodies are at an obtuse angle.

2. The folding snow shovel of claim 1 wherein said first and second members are further structured to move to a third, fully extended configuration, wherein the chords defined by said first and second member bodies are at angle greater than about 130 degrees.

3. The folding snow shovel of claim 1 wherein:

said first curved surface member body second distal edge defines a blade; and said second member includes at least one grip.

4. The folding snow shovel of claim 3 wherein said second member body second distal edge defines a first grip.

5. The folding snow shovel of claim 4 wherein said second member body includes a first elongated lateral opening extending substantially parallel and adjacent to said second member body second distal edge, said first opening extending substantially across the lateral width of said second member body.

6. The folding snow shovel of claim 1 wherein:

said first curved surface member body includes first and second stiffening members, said first and second stiffening members disposed at said first and second lateral sides of said first curved surface member body; and said second member body includes first and second stiffening members, said first and second stiffening members disposed at said first and second lateral sides of said second member.

7. The folding snow shovel of claim 1 wherein said first and second members are rotatably coupled together by a locking disk assembly.

8. The folding snow shovel of claim 1 wherein said first curved surface member body includes a radial extension, said radial extension extending generally toward the center of the arc defined by said first curved surface member.

9. The folding snow shovel of claim 1 wherein at least one of said first and second member bodies are made from a material having a highly visible color.

10. The folding snow shovel of claim 1 wherein at least one of said first and second members has a material of a highly visible color coupled thereto.

11. The folding snow shovel of claim 1 wherein:

said first curved surface member body has a length of between about 13 inches and 17 inches;

said first curved surface member body has a width of between about 8⅝ inches and 10½ inches; and said first curved surface member body has radius of curvature of between about 19 inches and 22 inches.

12. A folding snow shovel comprising:

a first curved surface member having a generally arcuate, elongated body with a first proximal edge, a second distal edge, two lateral sides and a width;

a second member having a generally elongated body with a first proximal edge, a second distal edge, two lateral sides and a width;

said first and second members rotatably coupled together adjacent each said member's first proximal edge, the axis of rotation extending substantially perpendicular to each of said first and second members' longitudinal axis;

said first curved surface member body second distal edge defines a blade;

said second member includes at least one grip;

wherein aid second member body second distal edge defines a first grip;

wherein said second member body includes a first elongated lateral opening extending substantially parallel and adjacent to said second member body second distal edge, said first opening extending substantially across the lateral width of said second member body; and wherein second member first grip is U-shaped wherein said first grip includes a first portion, a second portion, and a third portion, said grip first portion (122, p. 8, 1. 14) extending across said second member second distal edge, said grip second and third portions extending generally perpendicular to said grip first portion and along the outer edges of said second member immediately adjacent said grip first portion.

13. A folding snow shovel comprising:

a first curved surface member having a generally arcuate, elongated body with a first proximal edge, a second distal edge, two lateral sides and a width;

a second member having a generally elongated body with a first proximal edge, a second distal edge, two lateral sides and a width;

said first and second members rotatably coupled together adjacent each said member's first proximal edge, the axis of rotation extending substantially perpendicular to each of said first and second members' longitudinal axis;

said first curved surface member body second distal edge defines a blade;

said second member includes at least one grip;

wherein said second member body second distal edge defines a first grip;

wherein said second member body includes a first elongated lateral opening extending substantially parallel and adjacent to said second member body second distal edge, said first opening extending substantially across the lateral width of said second member body;

said second member body has a second grip spaced from said first proximal edge;

said second member body includes a second, elongated medial opening extending substantially parallel and adjacent to said second member body first proximal edge, said opening extending substantially across the lateral width of said second member body; and said second grip disposed at the inner edge defined by said second opening.

14. A folding snow shovel comprising:

a first curved surface member having a generally arcuate, elongated body with a first proximal edge, a second distal edge, two lateral sides and a width;

a second member having a generally elongated body with a first proximal edge, a second distal edge, two lateral sides and a width; and said first and second members rotatably coupled together adjacent each said member's first proximal edge, the axis of rotation extending substantially perpendicular to each of said first and second members' longitudinal axis;

wherein said first and second members are rotatably coupled together by a locking disk assembly;

said locking disk assembly includes an axle, a cam member, at least two disks;

said at least two disks including a first disk and a second disk, each disk having a center opening;

said first disk having an interface side and an outer side), said interface side having a plurality of radial ridges and grooves;

said second disk having an interface side with a plurality of radial ridges and grooves, said second disk interface side radial ridges and grooves corresponding to said first disk interface side radial ridges and grooves;

said first and second disks disposed with said interface sides engaging each other;

said axle extending through the center opening of each of said first and second disks, said axle having a cap on each end structured to prevent the axle sliding through said center openings;

said cam member having an L-shaped body with a lever arm), an extension, and a cam surface, said lever arm being longer than said extension, said lever arm and said extension coupled at a vertex, said cam surface extending over the outer surface of said vertex;

said cam member pivotally coupled to said axle with said extension engaging an axle cap;

said cam surface engaging said first disk outer side;

said first disk fixed to said first curved surface member body;

said second disk fixed to said second member body; and wherein said cam member is structured to move from a locked position, wherein said lever arm extends generally parallel to said first disk outer side and wherein said first and second disks are biased together with said ridges and groove interlocking, and a second position, wherein said lever arm extends at an angle to said first disk outer side and wherein said first and second disks are not biased together thereby allowing said first and second disk interface sides to rotate relative to each other.

15. The folding snow shovel of claim 14 wherein:

said locking disk assembly at least two disks includes four disks, said first and second disks as well as a third and fourth disk, each disk having a center opening;

said third disk having an interface side and an outer side, said interface side having a plurality of radial ridges and grooves;

said fourth disk having an interface side with a plurality of radial ridges and grooves, said fourth disk interface side radial ridges and grooves corresponding to said third disk interface side radial ridges and grooves;

said axle also extending through the center opening of each of said third and fourth disks;

said third and fourth disks disposed with said interface sides engaging each other;

said third disk fixed to said first curved surface member body; and said fourth disk fixed to said second member body.

16. The folding snow shovel of claim 15 wherein:

said first disk is disposed at said first curved surface member body first lateral side;

said second disk is disposed at said second member body first lateral side;

said third diskis disposed at said first curved surface member body second lateral side; and said fourth disk is disposed at said second member body second lateral side.

17. The folding snow shovel of claim 16 wherein:

said second member body includes a tubular portion, said tubular portion having an axial opening extending therethrough;

said tubular portion extending between said second disk and said fourth disk; and said axle extending through said tubular portion axial opening.

18. The folding snow shovel of claim 17 wherein said tubular portion is structured to act as a grip.

19. A folding snow shovel comprising:

a first curved surface member having a generally arcuate, elongated body with a first proximal edge, a second distal edge, two lateral sides and a width;

a second member having a generally elongated body with a first proximal edge, a second distal edge, two lateral sides and a width;

said first and second members rotatably coupled together adjacent each said member's first proximal edge, the axis of rotation extending substantially perpendicular to each of said first and second members' longitudinal axis;

said first and second members are made from a non-metallic material;

said first curved surface member includes an elongated metal blade; and said metal blade coupled to said first curved surface member second distal edge.

* * * * *